US005287821A

United States Patent [19]

Godbersen

[11] Patent Number: 5,287,821

[45] Date of Patent: Feb. 22, 1994

[54] ELECTRIC DRIVE MECHANISM FOR BOAT HOIST WINCH

[76] Inventor: Byron L. Godbersen, Lake LaJune Estates, Ida Grove, Iowa 51445

[21] Appl. No.: 44,802

[22] Filed: Apr. 12, 1993

[51] Int. Cl.[5] ..... B63C 15/00

[52] U.S. Cl. ..... 114/44; 187/8.59; 254/362; 254/363; 405/3

[58] Field of Search ..... 114/44; 405/3; 187/8.59; 254/4 R, 4 C, 266, 362, 363; 74/494

[56] References Cited

U.S. PATENT DOCUMENTS 3,648,539 3/1972 Rouis ..... 74/494

4,954,011 9/1990 Stenson ..... 405/3

*Primary Examiner*—Sherman Basinger

*Attorney, Agent, or Firm*—Henderson & Sturm

[57] ABSTRACT

In a boat hoist having a platform for raising and lowering a boat by a normally manually rotated circular lift wheel, winch, and cable arrangement, an electrically powered drive motor assembly mounted adjacent the lift wheel and including a drive wheel biased between a position of non-engagement with the lift wheel, and a position of engagement therewith for rotation of the lift wheel, power for the drive motor provided by the DC power source within the boat being moved or by a shore supplied AC power source.

10 Claims, 4 Drawing Sheets

ELECTRIC DRIVE MECHANISM FOR BOAT HOIST WINCH

TECHNICAL FIELD

This invention relates generally to boat hoists utilizing a rotating, circular lift wheel for raising and lowering a boat supporting platform via a winch and cable arrangement, and more particularly to an electric drive unit for rotating the lift wheel by electric power obtained from the boat itself.

BACKGROUND ART

Contemporary boat hoists of the type described in the Technical Field utilize either manual means for rotating the lift wheel, or electric drives are provided powered by either AC or DC sources of supply, but again with the electric drives manually engaged with the lift wheel. Although such electric drive units can be counterbalanced, it can well be appreciated that additional mechanism need be provided and with the end result still being the application and firm holding of the drive against the lift wheel, a manual effort difficult for some. Those concerned with these problems recognize the need for an improvement in this area of providing a safe, electric drive to the conventional lift wheel as an alternative to the manual rotation.

SUMMARY OF THE INVENTION

The present invention relates to a conventional boat hoist which has an upright frame including a plurality of posts for supporting a horizontally disposed platform which is raised and lowered relative to the water level by a winch, pulley and cable arrangement interconnected between the frame, posts and platform movement of the winch being effected by rotating a large circular lift wheel, with the invention comprising an electric drive mechanism for operating the winch via the lift wheel and which mechanism utilizes the DC power source of the boat which is being raised or lowered, thereby obviating the need of either manual effort or shore provided AC power under these circumstances.

It is therefore an object of this invention to provide a novel mechanism for electrically rotating the lift wheel of the conventional boat hoist.

It is another object of this invention to provide a lift wheel rotating mechanism which is readily positioned to permit manual rotating the lift wheel.

It is still another object of this invention to provide such a lift wheel rotating mechanism readily and easily positioned for electric rotation of the lift wheel.

Still another object of this invention is to provide such a lift wheel rotating mechanism which utilizes either the DC power of the boat which is being moved, or AC power from the shore.

BRIEF DESCRIPTION OF THE DRAWINGS

These and other attributes of the invention will become more clear upon making a thorough review and study of the following description of a preferred embodiment, particularly when reviewed in conjunction with the drawings, wherein.

BEST MODE CARRYING OUT THE INVENTION

Figure 1:
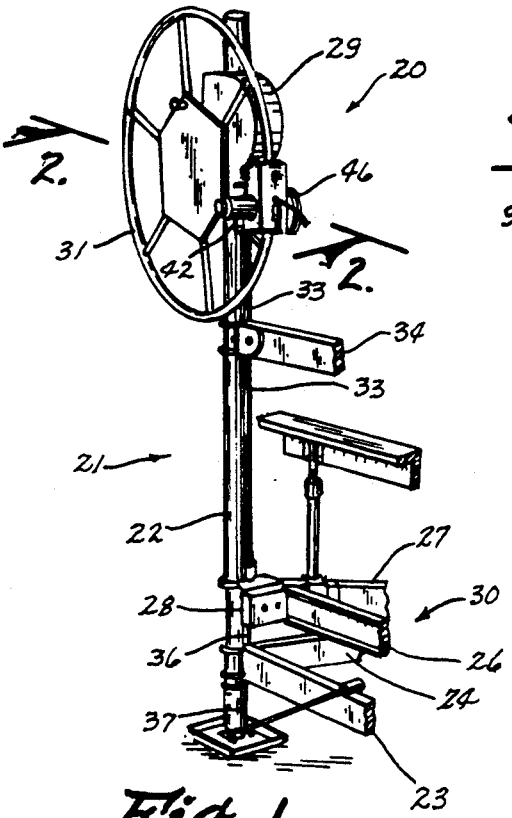
FIG. 1 is a perspective view of a boat hoist showing the electric drive mechanism for rotating the circular lift wheel for the hoist winch of this invention.

Referring now to the drawings wherein like reference numerals designate identical or corresponding parts throughout the several views, FIG. 1 shows the electric drive mechanism of this invention indicated generally at (20) and shown mounted on a conventional boat hoist (21) as described in full detail in U.S. Pat. No. Re. 32,118, reissued Apr. 22, 1986, filed Nov. 19, 1984, Ser. No. 672,918, the description of which is incorporated herein in full.

The hoist (21), only a portion of which is illustrated herein, comprises normally four posts, one (22) of which is shown, arranged in a rectangle and supporting a fixed frame including horizontally disposed bottom rails, two (23), (24) of which are shown herein, which rails (23), (24) are connected at each end to a post (22), and four horizontally disposed beams, two (26), (27) of which are shown herein, interconnected to form a rectangular platform (30). At each corner of the platform (30), a slide plate (28) is secured for sliding engagement with an adjacent post (22) whereby the platform (30) is movable vertically on the quartet of posts.

To raise or lower the platform (30), a winch unit (29) (FIG. 1) is provided, the winch unit (29) operated by rotation of a large, circular lift wheel (31), and the winch unit (29) including a cable (33) depending to a pulley (not shown) mounted within a top rail (34) secured between adjacent posts; a second cable (36) depending from another pulley (not shown) within the rail (34), and a third cable (37) secured at its one end to the bottom rail (23) and disposed over a pulley (not shown) in the rail (23). The cables (33), (36) and (37) are interconnected as described in Re. 32,118 with the posts, frame and platform (30) to effect a level raising and lowering of the platform (30). In its lower position, the platform (30) can either receive a boat for raising to a position out of the water, or to launch a boat therefrom. All movement of the platform (30) is in response to rotation; either clockwise or counterclockwise of the lift wheel, depending upon the desired vertical movement.

Figure 3:
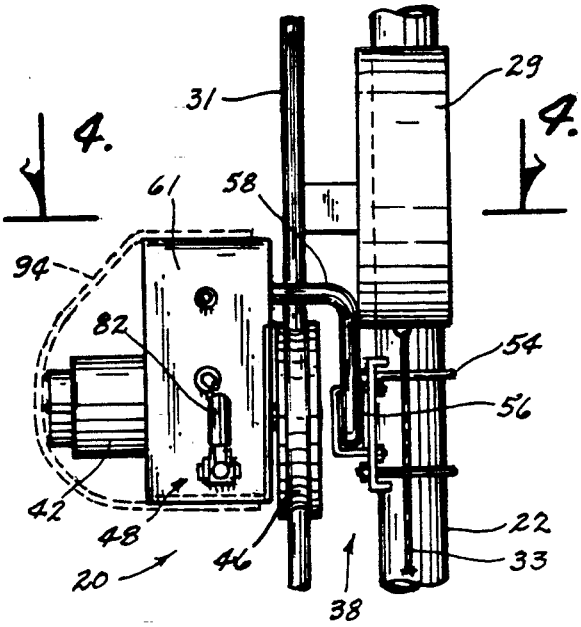
FIG. 3 is an elevational view taken along the line 3—3 in FIG. 2.
Figure 2:
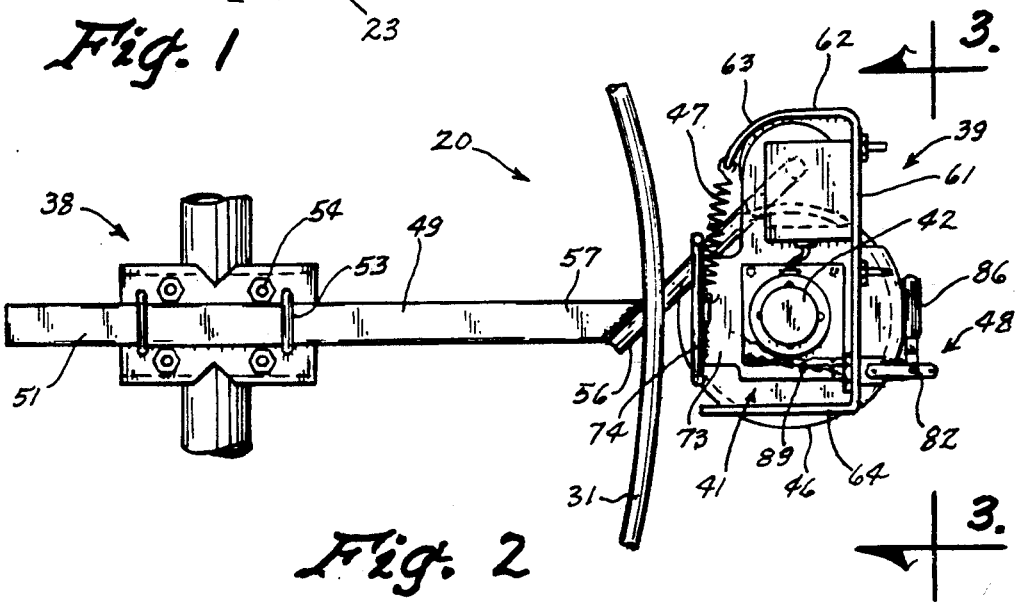
FIG. 2 is a fragmentary side elevational view thereof as taken along the line 2—2 in FIG. 1.
Figure 4:
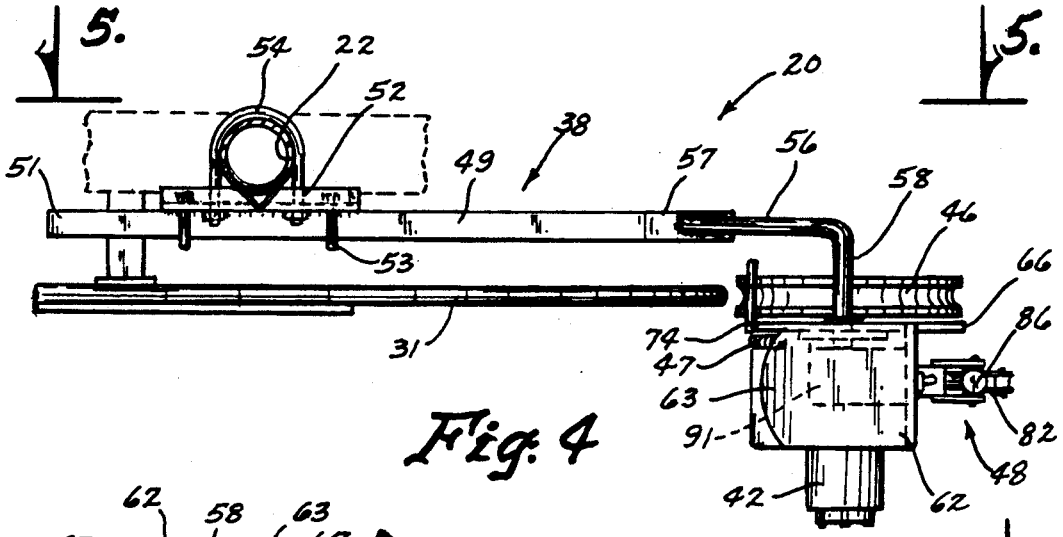
FIG. 4 is a plan view taken along the line 4—4 in FIG. 3.
Figure 5:
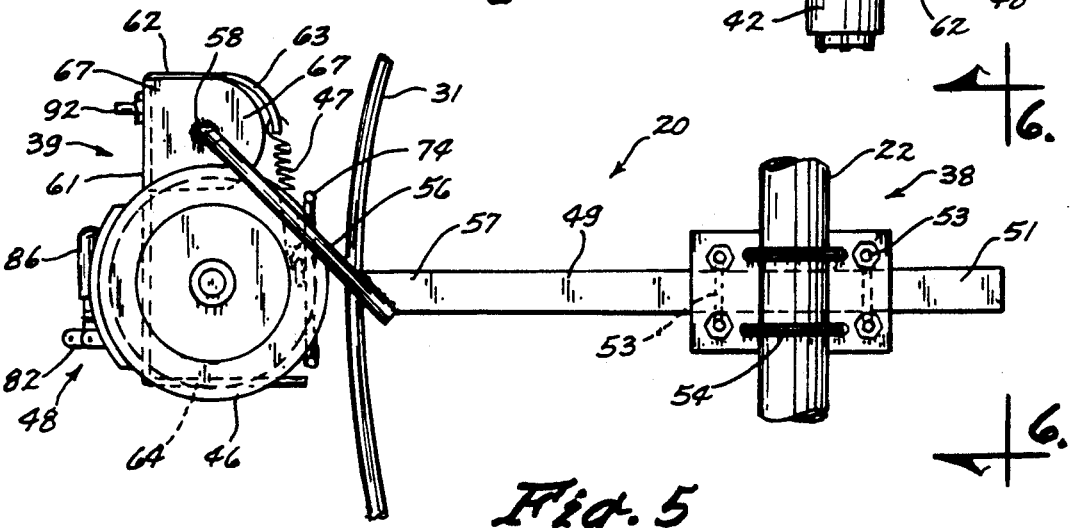
FIG. 5 is a side elevation view opposite that of FIG. 2, as taken along the line 5—5 of FIG. 4.
Figure 6:
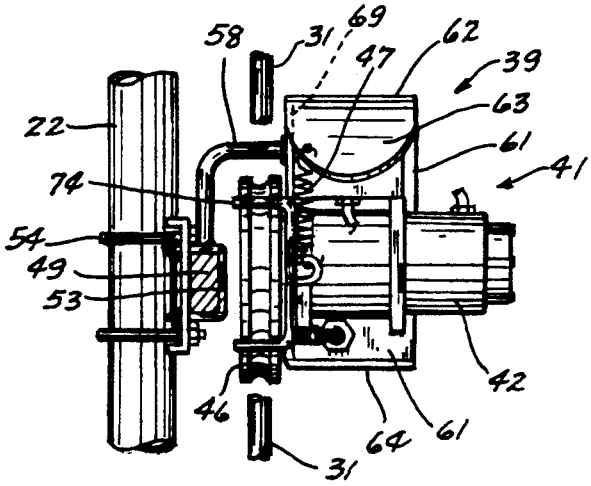
FIG. 6 is an elevational view taken along the line 6—6 in FIG. 5, certain parts broken away for clarity of illustration.
Figure 7:
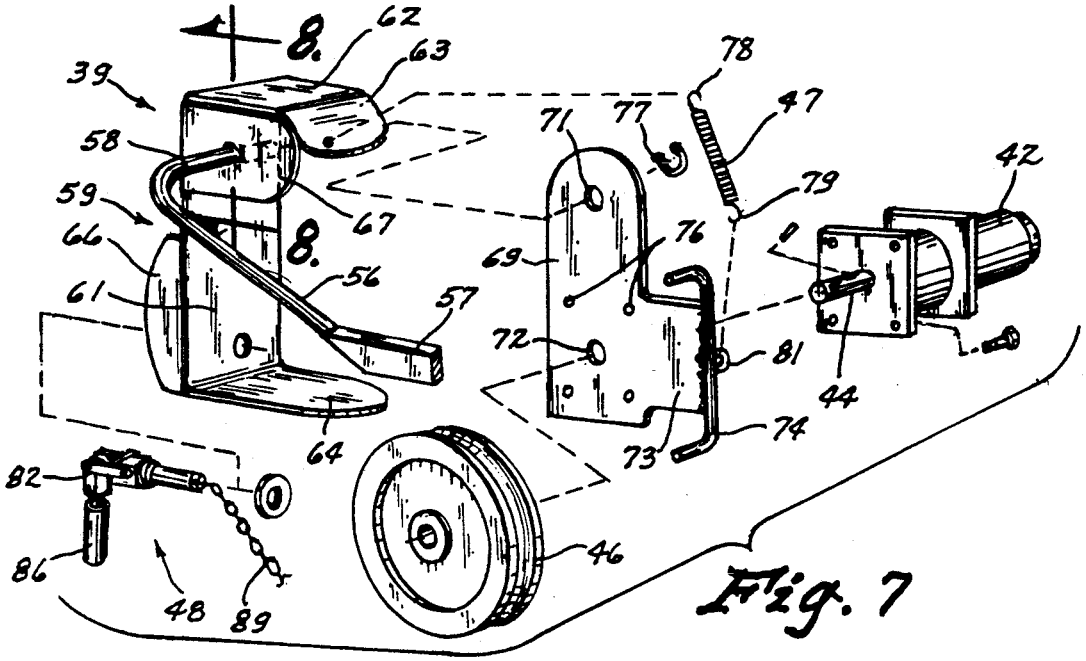
FIG. 7 is an exploded view of certain elements of the invention.
Figure 12:
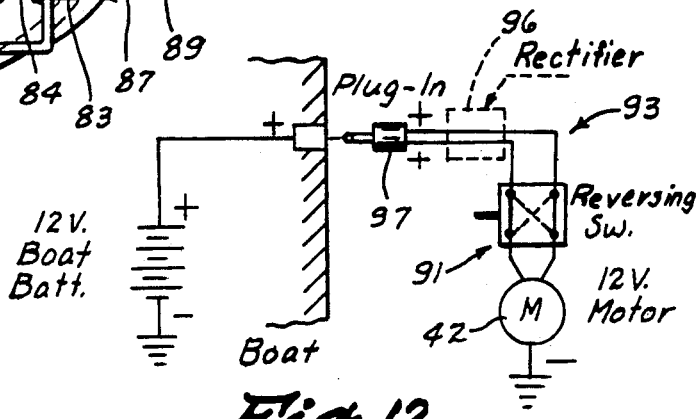
FIG. 12 is a schematic of electrical components relating to the invention, and showing alternative use of either a DC or AC source of power supply.

The electric drive mechanism (21) comprises generally an arm unit (38) (FIGS. 2–4) secured to the post (22) adjacent the lift wheel (31), a carriage unit (39) (FIGS. 5–7) mounted on an outer free end of the arm unit (38); a plate assembly (41) (FIGS. 2, 6) pivotally mounted on the arm unit (38) and including an electric motor (42) having wiring (see FIG. 12) detachably connectable to a boat source of power, such as a DC 12-volt battery (43), or to a shore source (not shown) if required, for energizing the motor (42), and the motor (42) having a drive shaft (44), (FIG. 7) with a circular drive wheel (46) secured to the drive shaft (44) for rotation therewith. It is readily apparent that the drive wheel (46) for rotating the lift wheel (31) as described hereinafter is considerably smaller in diameter than the lift wheel (31).

Figure 11:
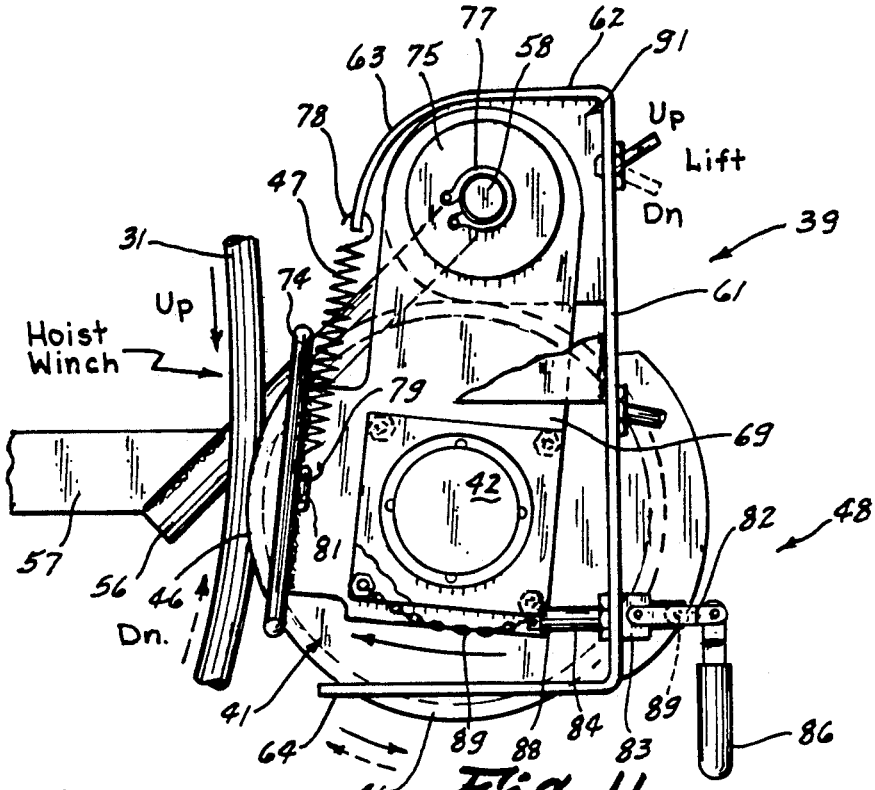
FIG. 11 is a view similar to FIGS. 9 and 10, and showing a still further changed condition of the certain elements.

The drive mechanism (21) comprises further a first unit in the specific form herein of a coil spring (47) (FIGS. 2, 5 and 6) interconnected between the carriage unit (39) and the plate assembly (41) for biasing the plate assembly (41) from a first position wherein the drive wheel (46) is spaced from the lift wheel (31) (FIG. 9) to a second position wherein the drive wheel (46) drivingly engages the lift wheel (31) (FIG. 11). Additionally, the mechanism (21) is completed in general with a second unit (48) (FIG. 4) which is operable in a first position to resist the bias of the spring (47) whereby to retain the drive wheel (46) spaced from the lift wheel (31) (FIG. 9), and in a second position to release the resistance whereby the spring (47) is then capable of forcing the drive wheel (46) into driving engagement with the lift wheel (31) (FIG. 11).

More particularly, the arm unit (38) includes an elongated, tubular arm (49) (FIG. 2), one end (51) of which is adjustably secured to the post (22) by a U-shaped channel (52) (FIG. 6), smaller U-bolts (53) securing the arm end (51) to the channel (52) and larger U-bolts (54) securing the channel (52) to the post (22). An L-shaped rod (56) is secured at one end as by welding to the arm opposite end (57) (FIG. 7), with the turned end (58) of the rod (56) disposed normal to the vertical plane of rotation of the lift wheel (31).

Figure 8:
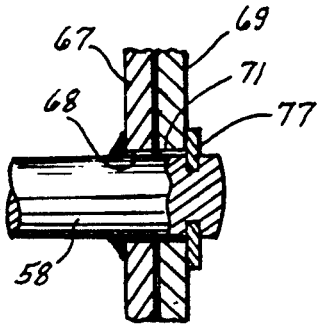
FIG. 8 is an enlarged sectional view as taken along the line 8—8 in FIG. 7, assuming the elements assembled.

The carriage unit (39) includes a C-shaped member (59) the open face of which faces the lift wheel (31) (FIG. 2), the member (59) having an upright back panel (61) (FIG. 7), a top panel (62) curved downwardly at its front edge (63), and a base panel (64), both top and base panels (62), (64) respectively, disposed substantially normal to the back panel (61). A side flange (66) is secured to one side edge of the back panel (61) and extends rearwardly as a guard for the drive wheel (46) (see FIG. 11). The carriage unit (39) includes further a mounting panel (67) secured to an edge of the back panel (61) and extends forwardly below an edge of the top panel (62) and has an opening (68) (FIG. 8) for receiving the arm unit rod end (58). By welding the rod end (58) and mounting panel (67) together, the carriage unit (39) is secured in a fixed manner to the arm unit (38).

The plate assembly (41), in addition to the electric drive motor (42) and drive shaft (44) (FIG. 7), includes a motor mounting plate (69) having an upper opening (71) and a lower opening (72) formed therein, and with a side portion (73) extended from the plate (69) and supporting, as by welding, a U-shaped wheel protector rod (74) in an upright manner. Mounting bolt openings (76) are also formed within the central portion of the plate (69) to provide for mounting the drive motor (42) thereto, with the drive shaft (44) extended through the lower opening (72) and below the carriage top panel (62), and the mounting plate (69) is swingably or pivotally mounted on the arm unit (38) via the rod end (58) (FIGS. 7 and 8) extended through the upper opening (71) and secured as by a washer (75) and cotter key (77). It will be noted then that the mounting plate (69) swings pivotally adjacent the carriage unit mounting panel (67) and within the C-shaped member (58).

The drive wheel (46) is secured on the free end of the drive shaft (44) and is disposed laterally outwardly of the carriage unit member (58) (FIG. 6), such that the plate assembly (41) pivotally moves in a plane parallel to the plane of rotation of the lift wheel (31), and with the drive wheel (46) rotating in a plane o rotation aligned with the plane of rotation of the lift wheel (31).

Figure 9:
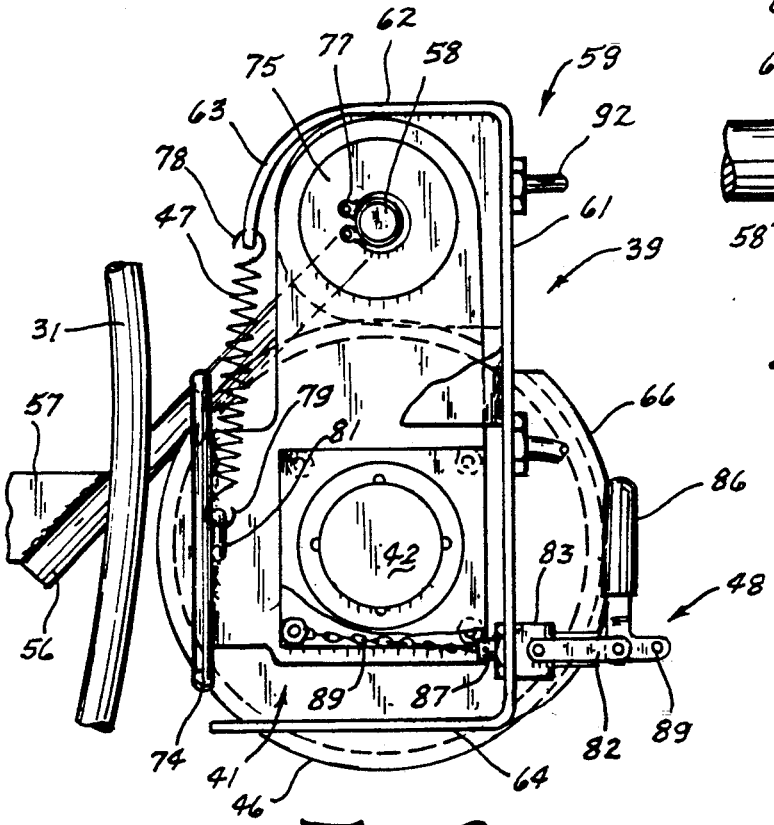
FIG. 9 is an enlarged view of a portion of FIG. 2.
Figure 10:
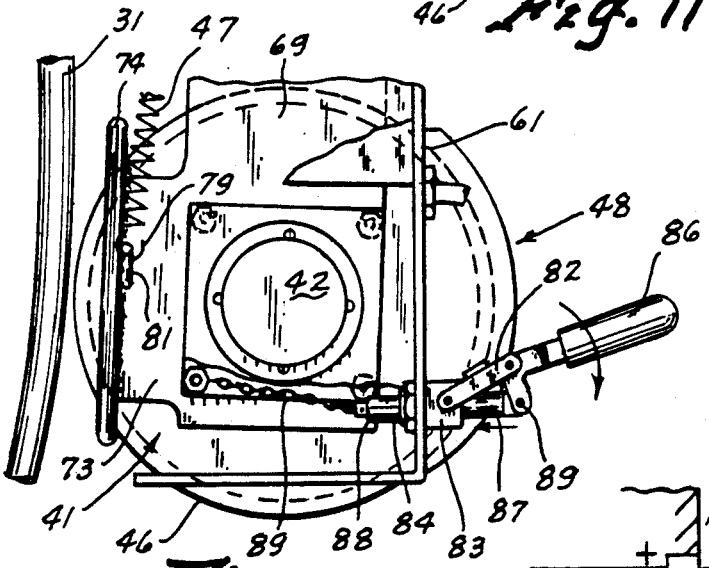
FIG. 10 is a view similar to FIG. 9 and showing a changed condition of certain elements.

The coil spring (47) is secured at one end (78) (FIGS. 2 and 6) to the carriage top panel front edge (63) and at the opposite end (79) to an eyelet (81) secured to the protector rod (74); and the tension of the spring (47) constantly biases and tends to pivotally pull the plate assembly (41) in a clockwise direction about the pivot rod end (58), as viewed in FIGS. 9–11, wherein the plate assembly (41) tends to move from a first position with the drive wheel (46) spaced from the lift wheel (31) (FIG. 9) to a second position with the drive wheel (46) drivingly engaged with the lift wheel (31) and held in the second position by action of the spring (47) (FIG. 11).

The plate assembly (41) is normally retained in its first position (FIG. 9) by the second unit (48) which includes an over-center lever unit (82) (FIG. 10) secured to the carriage unit back panel (61) and through which a plunger (84) is movable toward and away from the plate assembly (41) by a conventional over center handle (86) connected at one end (87) of the plunger (84) (FIG. 10). The other end (88) of the plunger (84) is connected by a chain (89) to the drive motor (42) part of the plate assembly (41). In the first position of the plate assembly (41) (FIG. 9), the plunger (84) has been moved to the right as viewed and away from the plate assembly (41), with the chain (89) taut and holding the plate assembly (41) against the bias of the spring (47). Upon movement of the plunger (84) toward the plate assembly (41), the tautness of the chain (89) is relaxed (FIG. 10), until extreme leftward movement of the plunger (84) (FIG. 11) releases the resistance of the chain (89) to the bias of the spring (47), whereby the drive wheel (46) drivingly engages the lift wheel (31). After rotation of the lift wheel (31), due to rotation of the drive wheel (46), the drive wheel (46) is again separated from the lift wheel (31) and repositioned in its normal, first position by reverse operation of the lever unit (82) returning the plunger (84) to its position most withdrawn to the right of the housing (83), with the chain (89) pulled taut and stretching the spring (47) to pivotally move the plate assembly counter-clockwise as viewed in FIG. 9, whereby to separate the drive wheel (46) from the lift wheel (31).

The electric drive mechanism (20) is completed by a drive motor reversing mechanism (91) (FIG. 2) being secured to the plate unit back panel (61) above the drive motor (42), and with a toggle switch (92) provided for switching the drive rotation of the motor (42) via the reversing mechanism (91).

In operation, electric wiring (93) (FIG. 12) is provided connected to the toggle switch (92) for electric connection to a boat battery (43), whereby as the boat has been moved to a location on the hoist platform (30) for raising or lowering, operation of the toggle switch (92) effects appropriate drive rotation of the drive wheel (46), in turn applied frictionally to the lift wheel (31) for appropriate movement of the platform (30) and boat. Subsequent thereto, the switch (92) can be changed to an "off" position (FIG. 12), or reversed as the case may be; and the condition of the drive wheel (46) changed as desired by operation of the over-center lever unit (82). A cover (94) of waterproof cloth or the like may be placed over the carriage unit (39), plate assembly (41), first and second units (47), (48), respectively for protection against inclement weather.

Should it be desired to use a 110 AC power source, from the shore for example, the same electrical circuitry is utilized with the exception that a conventional full wave rectifier (96) is inserted in the wiring (93). Thus, with the plug (97) connected to an AC source (not shown), the rectifier converts the AC to DC prior to connection with the reversing switch (91), such that normal operation of the toggle switch (92) effects rotation of the motor (42) in either one of two rotational directions for appropriate drive rotation of the drive wheel (46) as described hereinbefore.

I claim:

1. In a boat hoist having a frame including at least a pair of spaced posts, a platform for supporting a boat movably mounted on the posts, a winch having a cable arrangement interconnected with the platform, a circular lift wheel for rotating the winch to move the platform in a vertical direction, and the boat provided with a DC source of power, an electrically powered mechanism for rotating the lift wheel comprising:

arm means secured to one of the posts adjacent the lift wheel;

carriage means mounted on said arm means;

plate means pivotally mounted on said arm means and including an electric motor having wiring detachably connectable to the boat source of power for energizing said electric motor, said electric motor having a drive shaft;

a circular drive wheel secured to said drive shaft for rotation therewith;

first means interconnected between said carriage means and said plate means for biasing said plate means from a first position wherein said drive wheel is spaced from the lift wheel to a second position wherein said drive wheel drivingly engages the lift wheel; and second means interconnected between said carriage means and said plate means and operable in a first position to resist the bias of said first means whereby to retain said drive wheel spaced from the lift wheel, and operable in a second position to release said resistance whereby said drive wheel drivingly engages the lift wheel to impart drive thereto in response to energization of said electric motor.

2. The invention of claim 1, and further wherein said arm means includes an elongated arm having one end adjustably secured to the post, and having an opposite end supporting said carriage means.

3. The invention of claim 2, and further wherein said carriage means includes a C-shaped member facing the lift wheel.

4. The invention of claim 3, and further wherein said plate means includes a plate pivotally mounted on said arm opposite end.

5. The invention of claim 4, and further wherein said circular drive wheel rotates in a plane of rotation aligned with the plane of rotation of the lift wheel.

6. The invention of claim 5, and further wherein said first means comprises a coil spring.

7. The invention of claim 6, and further wherein said second means includes an over-center lever unit secured to said C-shaped member and including a chain connected between said lever unit and said plate means.

8. The invention of claim 2, and further wherein said arm means includes a rod secured to said arm opposite end and extended normal to the plane of rotation of the lift wheel.

9. The invention of claim 8, and further wherein said plate means includes a plate pivotally mounted on said rod for movement in a plane parallel to the plane of rotation of the lift wheel.

10. The invention of claim 9, and further wherein said plate means includes a reversing mechanism for said electric motor whereby said drive shaft and said drive wheel can be rotated in opposite directions.

* * * * *